United States Patent [19]

Steinbauer, Jr. et al.

[11] 4,312,624

[45] Jan. 26, 1982

[54] AIR COOLED HOLLOW VANE CONSTRUCTION

[75] Inventors: Frederick W. Steinbauer, Jr., West Palm Beach; Erik A. Lindstrom, Palm Beach Gardens, both of Fla.

[73] Assignee: United Technologies Corporation, Hartford, Conn.

[21] Appl. No.: 205,833

[22] Filed: Nov. 10, 1980

[51] Int. Cl.[3] ..... F01D 5/18; F01D 9/02

[52] U.S. Cl. ..... 415/115; 415/116

[58] Field of Search ..... 415/115, 116; 416/96 A, 416/97 R, 97 A

[56] References Cited

U.S. PATENT DOCUMENTS

| | | | |
|---|---|---|---|
| 3,628,880 | 12/1971 | Smuland et al. | 416/96 A |
| 3,799,696 | 3/1974 | Redman | 416/96 A |
| 3,930,748 | 1/1976 | Redman et al. | 416/97 A |
| 3,950,114 | 4/1976 | Helms | 416/97 A |
| 4,063,851 | 12/1977 | Weldon | 416/96 A |
| 4,135,855 | 1/1979 | Peill | 416/96 A |
| 4,162,136 | 7/1979 | Parkes | 416/96 A |

FOREIGN PATENT DOCUMENTS

| | | | |
|---|---|---|---|
| 2017229 | 10/1979 | United Kingdom | 416/96 A |

*Primary Examiner*—Robert E. Garrett
*Attorney, Agent, or Firm*—Stephen E. Revis

[57] ABSTRACT

To improve cooling and simplify construction the cavity of a hollow airfoil is divided into separate longitudinally extending pressure and suction side compartments each of which extend from the leading edge to the trailing edge portion of the airfoil for providing cooling air to their respective sides of the airfoil. Air enters one compartment from one end of the airfoil and is closed at its opposite end. Air enters the other compartment from the end opposite the inlet end of the first compartment and is closed at its other end. In a preferred embodiment a tubular insert provides the dividing wall between the compartments and forms a plenum within the suction side compartment from which cooling air is directed against the suction-side wall through impingement cooling holes in the insert.

10 Claims, 4 Drawing Figures

AIR COOLED HOLLOW VANE CONSTRUCTION

DESCRIPTION

Technical Field

This invention relates to cooled, hollow airfoils.

Background Art

It is well known in the art to cool hollow airfoils utilizing inserts and compartments within the airfoil to properly distribute cooling fluid. For example, it may be desirable to cool an airfoil wall by film cooling, wherein cooling fluid from a compartment within the hollow airfoil is directed through holes in the airfoil wall and thence forms a cooling film over the outer surface of the airfoil. The pressure in the compartment must, of course, be maintained higher than the pressure on the other side of the wall being cooled. In some instances it may be desirable to cool an airfoil wall by impingement and convention cooling. In that type of cooling a plenum, which may be formed by a tube disposed within the airfoil, includes an apertured wall closely spaced from the wall to be cooled defining a cooling space therebetween. Jets of cooling air are directed from the plenum through the apertures onto the inner surface of the wall to be cooled, and then flow through the cooling space along the internal surface of the wall. A sufficiently high pressure drop must exist across the apertured plenum wall to create the jets of cooling air and to provide sufficient flow through the cooling space.

Cooling requirements for the pressure and suction sides of airfoils are often quite different, making it desirable to cool each of these surfaces by different methods, such as by impingement and convection cooling or by film cooling as discussed above. In the prior art, the cooling fluid for the pressure and suction sides of the airfoil has always been provided from a single pressure source; and the different pressures required at different locations within the airfoil and for the different types of cooling techniques has been provided by selected sizing of passageways and of apertures through insert walls leading to different chambers. Compromise designs often need to be used to assure sufficient cooling flow at all locations; or, in the alternative, cooling techniques other than those which would otherwise be most desirable for a particular portion of the airfoil are used.

Representative of the prior art discussed above are U.S. Pat. Nos. 3,301,527; 3,388,888; 3,529,902; 3,540,810; and 3,767,322. In 3,540,810, for example, the hollow portion of the airfoil is divided into fore and aft cavities by an insert; however, only the forward cavity receives cooling fluid from an external source. A portion of the cooling fluid from the fore cavity, after cooling certain areas of the airfoil, is fed into the aft cavity for distribution to other areas of the airfoil. One other patent of interest is U.S. Pat. No. 3,930,748 wherein the airfoil is divided into separate fore and aft compartments by a longitudinal strut extending between the pressure and suction sides. Each compartment has it own tubular insert, with each insert receiving its own flow of cooling fluid from a common source at the same end of the airfoil. The inserts operate independently to provide the desired cooling to the fore and aft portions of the airfoil.

DISCLOSURE OF INVENTION

One object of the present invention is a hollow vane assembly which provides improved cooling to the vane airfoil.

Another object of the present invention is a hollow vane assembly with independent cooling of the airfoil pressure side and the airfoil suction side.

Accordingly, the cavity of a hollow airfoil in a vane assembly is divided into longitudinally extending pressure side and suction side compartments by an insert, wherein both compartments extend from the airfoil leading edge wall to the trailing edge portion of the airfoil, and one compartment has cooling fluid inlet means at one end of the airfoil cavity and the other compartment has cooling fluid inlet means at the opposite end.

One important advantage of the present invention is that the suction side of the airfoil and the pressure side of the airfoil are cooled by different sources of cooling fluid which do not interact with each other inside the airfoil, thereby permitting the most desirable type of cooling for each side of the airfoil.

In one embodiment the insert is tubular and defines a plenum totally within the suction side compartment. The plenum extends the length of the airfoil cavity and from the airfoil leading edge wall to a trailing edge portion of the airfoil. The suction side compartment, including the plenum, is closed at one end and open at the other end which is the inlet for the cooling fluid. The pressure side compartment is closed by suitable means at its end adjacent the open or inlet end of the plenum, and is open at its other end which is an inlet for cooling fluid. A first wall portion of the insert is the dividing wall between the suction and pressure side compartments. A second wall portion of the insert is closely spaced from the airfoil suction-side wall defining a narrow cooling fluid space between the insert and the suction-side wall. Holes in the second wall portion direct cooling fluid from the plenum against the suction-side wall for impingement cooling thereof. This fluid also travels between the insert and the suction-side wall providing additional convection cooling of the suction-side wall. Cooling fluid within the pressure side compartment is directed through apertures in the pressure-side wall to create a film of cooling fluid over the outer surface of the pressure side of the airfoil. Preferably the leading edge wall also forms a part of the pressure side compartment and cooling fluid from that compartment also cools the leading edge wall.

With the foregoing preferred construction, the cooling fluid pressure in the suction-side plenum may be selected to assure the appropriate pressure drop across the insert's apertured wall to assure continuous and adequate impingement-convection cooling of the suction side of the airfoil without affecting the pressure side cooling of the airfoil. Thus, the pressure of the cooling fluid in the pressure side compartment may be maintained just slightly above the pressure on the external surface of the airfoil pressure-side wall and will not affect cooling of the suction-side wall. More effective and efficient cooling is thereby achieved throughout the airfoil with reduced likelihood that pressures outside the airfoil walls will exceed pressures inside the airfoil and result in reverse flow and inadequate cooling.

The foregoing and other objects, features and advantages of the present invention will become more apparent in the light of the following detailed description of the preferred embodiments thereof.

BEST MODE FOR CARRYING OUT THE INVENTION

Figure 1:
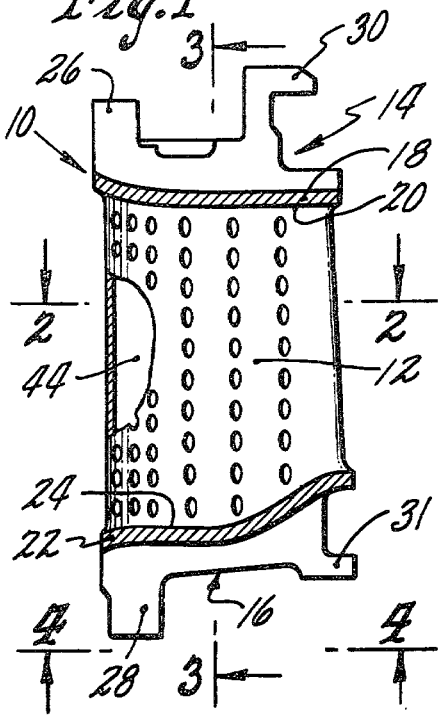
FIG. 1 is a side elevation view, partly broken away, of a turbine vane assembly constructed in accordance with the teachings of the present invention.

As an exemplary embodiment of the present invention, consider the gas turbine engine vane assembly shown in FIG. 1 and generally represented by the numeral 10. The vane assembly 10 comprises a hollow airfoil 12 disposed between and integral with radially inner airfoil support structure 14 and radially outer airfoil support structure 16. The inner structure 14 includes an inner platform 18 which defines an inner engine flowpath portion 20 of the vane assembly 10. The outer structure 16 includes an outer platform 22 which defines an outer engine flowpath portion 24. The inner and outer support structures 14, 16, also include means such as flanges 26, 28 and hooks 30, 31 for securing the vane assembly 10 within the engine. The support structure is not considered to be a part of the present invention.

Figure 2:
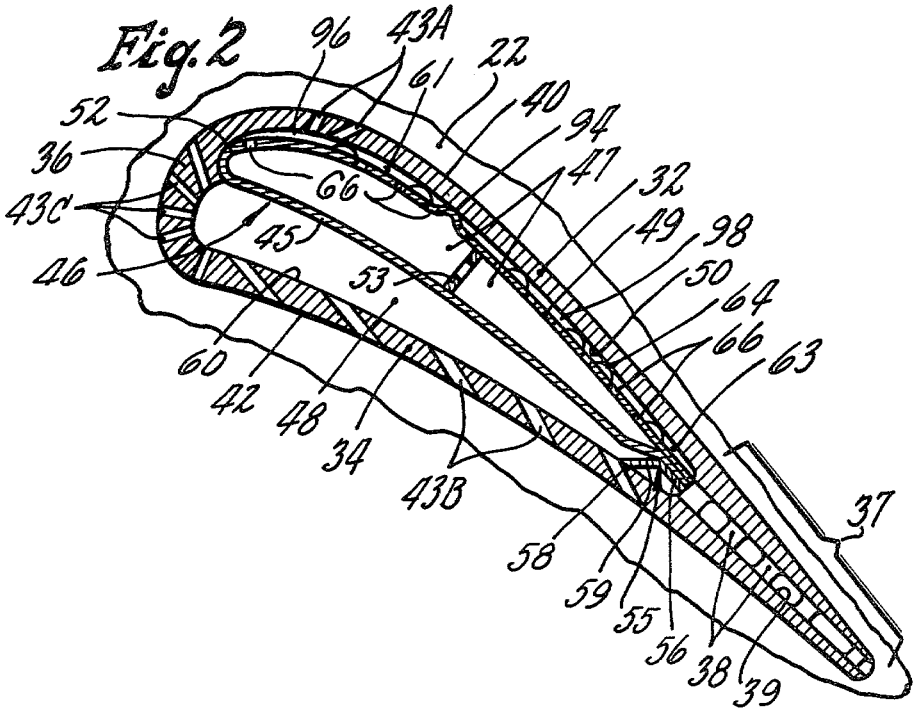
FIG. 2 is a transverse sectional view, greatly enlarged, taken along the line 2—2 of FIG. 1.

Referring to FIG. 2, the airfoil 12 comprises a suction-side wall 32, a pressure-side wall 34, and a leading edge wall 36. The suction-side wall 32 includes the convex, external suction surface 40 of the airfoil 12; and the pressure-side wall 34 includes the concave, external pressure surface 42 of the airfoil 12. The suction-side wall 32 and pressure-side wall 34 are closely spaced from each other near the aft end of the airfoil 12 defining the trailing edge portion 37 of the airfoil. A plurality of pedestals 38 maintain a cooling fluid passageway 39 through the trailing edge portion in a manner well known in the art. The wall portions 32, 34, and 36 define a cooling fluid cavity 44 (FIG. 1) which traverses the entire span of the airfoil 12 and also extends from the leading edge wall 36 to the trailing edge portion 37. Each of the airfoil walls 32, 34 and 36 have spanwise rows of cooling holes 43A, 43B, and 43C, respectively, passing therethrough for directing cooling fluid from inside the cavity 44 over the external surfaces of the airfoil.

Figure 3:
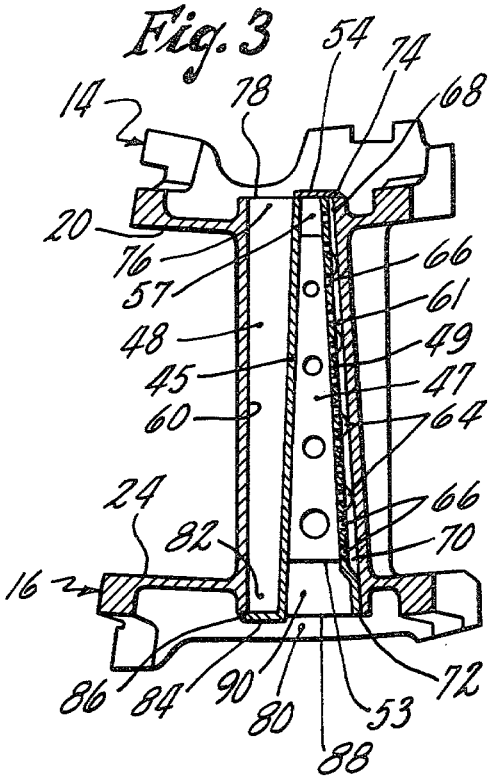
FIG. 3 is a longitudinal sectional view taken along the line 3—3 of FIG. 1.

As best shown in FIGS. 2 and 3, a thin walled, flattened tubular insert 46 is disposed within the cavity 44.

In this embodiment the insert 46 is constructed from a flat sheet which is formed, by bending, into a flattened tube having a curved forward edge 52 and wall portions 45, 49. The wall portions 45, 49 meet at the aft end of the cavity 44 and are joined by welding along their length. An apertured brace member 53 is welded between the wall portions 45, 49 for added strength over a portion of the insert's length. The relatively flat wall portion 45 of the insert 46 divides the cavity 44 into a tapered pressure side compartment 48, which includes the pressure-side wall 34 and substantially the entire leading edge wall 36, and an oppositely tapered suction side compartment (unnumbered) which is the volume of the cavity 44 between the wall portion 45 and the suction-side wall 32. The insert 46 forms a plenum 47 within the suction side compartment. The narrow, radially innermost end of the insert includes a plate 54 which seals the narrow end 57 of the plenum 47.

Both the suction side and pressure side compartments, as well as the plenum 47 extend from the leading edge wall 36 to the trailing edge portion 37, and traverse the entire span of the airfoil 12. A seal is provided between the two compartments at the leading edge wall 36 by having the curved, forward edge 52 of the tubular insert press against the inside surface of the leading edge wall over the span of the airfoil. A flapper seal 55 is provided at the aft end of the pressure side compartment. The flapper seal is an elongated piece of metal with a V-shaped cross section wherein one leg 56 of the V is welded along the spanwise length of the aft end of the wall portion 45; the edge 58 of the other leg 59 of the V is both spring and pressure loaded against the inner wall surface 60 of the pressure-side wall 34. The flapper seal prevents fluid in the pressure side compartment 48 from exiting through the trailing edge cooling fluid space 39.

The wall portion 49 of the insert 46 follows the contour of and is closely spaced from the suction-side wall 32, defining a narrow cooling fluid space 61 therebetween. The spanwise extending aft end 63 of the space 61 opens into the trailing edge cooling fluid passageway 39. Dimples 64 in the wall portion 49 maintain the proper spacing between the wall portion 49 and the wall 32. Holes 66 spaced over the length and width of the wall portion 49 provide fluid communication between the plenum 47 and the fluid space 61. The inner and outermost ends 68, 70, respectively, of the space 61 are sealed closed. Thus, at the outer end of the space 61 the insert 46 is welded along the length of its edge 72 to the outer support structure 16; and at the inner end of the space 61 the plate 54 is welded along its edge 74 to the inner support structure 14.

Figure 4:
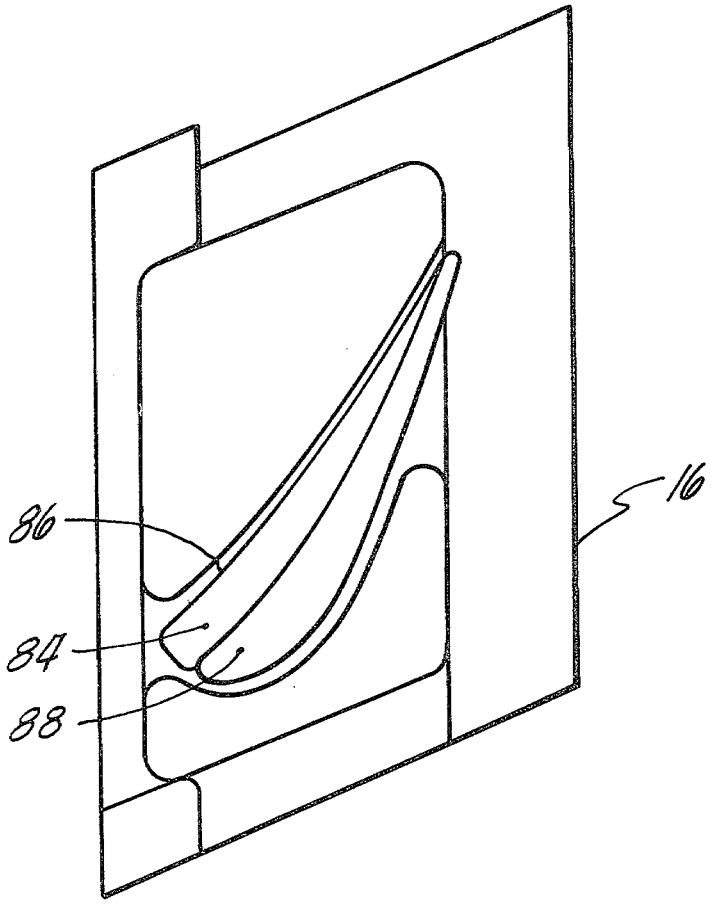
FIG. 4 is an end view of the vane assembly taken along the line 4—4 of FIG. 1.

As best seen in FIG. 3, the pressure side compartment 48 is open and widest at its radially innermost end 76, which forms an airfoil shaped cooling fluid inlet 78 adjacent the closed end of the plenum 47. The compartment 48 is narrowest at its radially outermost end 82 which is closed by the outwardly extending flange 84 on the outer end of the insert 46. The edge 86 of the flange is welded along its length to the support structure 16. The plenum 47, and thus the suction side compartment, has an airfoil shaped cooling fluid inlet 88 (best shown in FIG. 4) at its radially outermost, wide end 90.

In operation, the pressure side compartment 48 receives cooling air thru its inlet 78 from a suitable source within the engine. This air, at a pressure just above the pressure of the gas stream adjacent the external pressure surface 42 of the airfoil, film cools the leading edge wall 36 and the pressure-side wall 34 by exiting through the holes 43C, 43B therethrough, respectively. Cooling air from a different source and at a pressure somewhat less than the pressure in the pressure side compartment enters the plenum 47 via the inlet 88, and is directed against the inside surface of the suction-side wall via the impingement cooling holes 66 in the insert wall portion 49. The wall portion 49, in this particular embodiment, includes a spanwise extending protrusion or dam 94 which is in continuous contact with the suction-side wall along its length, thereby dividing the fluid space 61 into fore and aft separate portions 96, 98, respectively. Cooling fluid from the plenum 47 which enters the fore portion 96 of the space 61 exits from the vane via the film cooling holes 43A, while cooling fluid entering the aft portion 98 of the space 61 leaves the vane by way of the trailing edge portion cooling fluid passageway 39. If the film cooling holes 43A in the suction-side walls were not needed, the dam 94 could be eliminated and all cooling fluid from the plenum 47 would exit through the trailing edge portion cooling fluid passageway 39.

As described above, both the pressure and suction side compartments taper from their wide inlet ends 76, 90 to their narrow closed ends 82, 57. This is done to reduce, and preferably eliminate, a spanwise pressure gradient within each compartment, resulting in more uniform cooling over the length of the airfoil. Although tapered compartments are preferred, they are not required by the present invention.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A vane assembly for turbomachinery comprising:

a hollow airfoil having an inner end and an outer end and including wall means defining a leading edge wall, a suction-side wall having a suction surface, a pressure-side wall having a pressure surface, and a trailing edge portion, said wall means defining a cooling fluid cavity extending from said inner end to said outer end of said airfoil and from said leading edge wall to said trailing edge portion;

insert means disposed within said cavity including dividing wall means dividing said cavity into a pressure side compartment including said pressure-side wall and a suction side compartment including said suction-side wall, each of said compartments extending from said leading edge wall to said trailing edge portion over the entire span of said airfoil, said pressure side compartment providing cooling fluid to cool said pressure-side wall and said suction side compartment providing cooling fluid to cool said suction-side wall, said compartments being sealed from one another, said insert means including a tubular member defining a plenum within said suction side compartment extending from said airfoil inner end to said airfoil outer end and from said leading edge wall to said trailing edge portion, said tubular member being closed at one of its ends and having cooling fluid inlet means at its other end, said pressure side compartment being closed at its end opposite to the closed end of said tubular member and having cooling fluid inlet means at its other end, said tubular member having a first wall portion adjacent and spaced from said suction-side wall defining a narrow cooling fluid space therebetween, said first wall portion having holes therethrough for directing cooling fluid from said plenum into said passageway to cool said suction-side wall.

2. The vane assembly according to claim 1 wherein said tubular member includes a second wall portion which is said dividing wall means.

3. The vane assembly according to claim 2 wherein said tubular member includes a spanwise extending forward end which sealingly abuts said leading edge wall of said airfoil along the length of said leading edge wall.

4. A vane assembly according to claim 2 wherein said plenum is tapered from its inlet means, which is widest, to its closed end, which is narrowest, and said pressure side compartment is tapered from its inlet means, which is widest, to its closed end, which is narrowest.

5. The vane assembly according to claims 2 or 4 wherein said trailing edge portion includes cooling fluid passageway means therethrough, said cooling fluid passageway means being in communication with said cooling fluid space and adapted to receive cooling fluid therefrom to cool said trailing edge portion.

6. The vane assembly according to claim 5 wherein said pressure-side wall has apertures therethrough in communication with said pressure side compartment for directing cooling fluid from said pressure side compartment as a film over said pressure surface of said airfoil.

7. The vane assembly according to claim 6 wherein said pressure side compartment includes substantially the entire leading edge wall, and said leading edge wall has apertures therethrough in communication with said pressure side compartment for discharging cooling fluid from said pressure side compartment to cool said airfoil leading edge.

8. The vane assembly according to claim 4 including seal means dividing said cooling fluid space into at least first and second distinct portions, said suction-side wall having apertures therethrough communicating with said first distinct portion for directing cooling fluid from said first distinct portion, thru said suction-side wall to create a film over said suction surface of said airfoil.

9. The vane assembly according to claim 8 wherein each of said distinct portions of said cooling fluid space extends from said inner to said outer end of said airfoil.

10. The vane assembly according to claim 6 wherein said insert means includes seal means for separating said pressure side compartment from said trailing edge cooling fluid passageway means.

* * * * *